US005816294A

United States Patent [19]

Speich

[11] Patent Number: 5,816,294

[45] Date of Patent: Oct. 6, 1998

[54] HEDDLE SLIDE BAR ARRANGEMENT IN A WEAVING MACHINE SHAFT DEVICE

[75] Inventor: Francisco Speich, Hergiswil, Switzerland

[73] Assignee: Textilma AG, Hergiswil, Switzerland

[21] Appl. No.: 776,812

[22] PCT Filed: Jun. 28, 1995

[86] PCT No.: PCT/CH95/00146

§ 371 Date: Jun. 20, 1997

§ 102(e) Date: Jun. 20, 1997

[87] PCT Pub. No.: WO96/06212

PCT Pub. Date: Feb. 29, 1996

[30] Foreign Application Priority Data

Aug. 25, 1994 [DE] Germany ..... 9413705 U

[51] Int. Cl.[6] ..... D03C 9/00

[52] U.S. Cl. ..... 139/91; 139/93

[58] Field of Search ..... 139/91, 92, 93, 139/94, 96

[56] References Cited

U.S. PATENT DOCUMENTS

| | | | |
|---|---|---|---|
| 3,058,495 | 10/1962 | Kaufmann | 139/91 |
| 4,342,339 | 8/1982 | Koch | 139/96 |
| 4,492,256 | 1/1985 | Kramer | 139/92 |
| 4,790,357 | 12/1988 | Kramer . | |
| 5,176,183 | 1/1993 | Koch | 139/93 |
| 5,178,192 | 1/1993 | Koch | 139/93 |

FOREIGN PATENT DOCUMENTS

| | | |
|---|---|---|
| 0 344 428 | 4/1989 | European Pat. Off. . |
| 1535847 | 7/1970 | Germany . |
| 40 23 498 | 10/1991 | Germany . |
| 40 32 472 | 10/1991 | Germany . |
| 523987 | 6/1972 | Switzerland . |
| 544826 | 1/1974 | Switzerland . |
| 7327765 | 9/1984 | Taiwan . |
| 78202091 | 3/1989 | Taiwan . |

*Primary Examiner*—Andy Falik
*Attorney, Agent, or Firm*—McCormick, Paulding & Huber

[57] ABSTRACT

Each of the heddles of a shaft device for a weaving machine has a thread eyelet and end eyelets arranged on both sides of the thread eyelet, so that the heddles can be arranged in rows on heddle slide bars. At least the driving heddle slide bar has at least one thin leg that projects transversely to the plane formed by the heddle slide bar and engages a driving groove of the corresponding end eyelet of the heddle with limited play. In spite of the limited play, the heddles can be spread to a sufficient extent on the heddle slide bars. This limited play allows a better driving performance, with reduced noise level and wear, in comparison with known shaft devices.

10 Claims, 3 Drawing Sheets

HEDDLE SLIDE BAR ARRANGEMENT IN A WEAVING MACHINE SHAFT DEVICE

BACKGROUND OF THE INVENTION

1. Technical Field of the Invention

The present invention concerns a weaving machine or a shaft device.

2. State of the Art

Shaft devices of the kind used with weaving machines are known in various configurations. An example of such a device is known from the Swiss document CH-PS 523 987, which is described in more detail in the accompanying FIGS. 1–4. The known shaft devices require a relatively large amount of play between a driving heddle slide bar and the end eyelet of a heddle to ensure a sufficiently large spread or separation angle for the handling and manipulation of the heddles. Such a large amount of play causes, on the one hand, wear, and, on the other hand, a high noise level. Such shaft devices or weaving machines equipped with them therefore allow for a maximum speed of 2,500 r.p.m.

SUMMARY OF THE INVENTION

It is the object of the invention to improve a shaft device of the above mentioned kind so that the indicated drawbacks can be eliminated.

Accordingly, so that the drive for a heddle is produced by means of at least one thin leg on the heddle driving slide bar, the leg being transverse to the plane formed by the slide bar, the leg engages a receiving groove of the associated end eyelet of the heddle with minimal free play. Even at maximum speed, for instance 4,000–6,000 cycles per minute, this utterly small play generates only a very reduced noise and causes only minimal wear. This novel shaft device or weaving machine equipped with such a device therefore yields a better driving performance with comparatively lower noise level and reduced wear.

It is possible to improve the life of the shaft device through a pair of legs engaging corresponding grooves in the eyelet of the heddle, since in this case the driving force is distributed over two legs. Wear is reduced at the same time, and so is noise level which usually worsens with the increasing wear.

In principle, it is possible to arrange the leg of the driving heddle slide bar at any height of the driving heddle slide bar, preferably the side of the bar facing the thread eyelet.

With regard to the design and alignment of the legs, there are several possibilities. The configuration with the leg arranged parallel to the plane of the warp thread allows for the most favorable distribution of forces.

A configuration of the slide bars, in particular of the driving heddle slide bar, is specifically advantageous when the bar has an L-, C- or T-shaped cross section. Profiling, that is sectioning, enables firstly the forming of the leg and ensures, secondly, a good flexural moment of inertia with low mass in comparison to a full profile of the slide bar. The lower mass of the slide bars favors higher operative speeds and contributes to the reduction of noise and wear.

In principle, the end eyelets can have an opening at the one side transverse to the direction of motion. More preferable, however, is the configuration in which the eyelet circumscribes the heddle driving slide bar.

An advantageous amount of play is 0.01–0.1 mm. An advantageous width of the driving groove is 1.0 mm. An estimation of advantageous vertical play between the end eyelet and the idle slide bar to ensure a separation angle required for the handling of the heddles is 0.5–10 mm.

In principle the heddle may have any configuration, but a laminated configuration is of a special advantage. It allows for good tensile and wear properties with a minimum need for lateral spaces.

Especially advantageous is a configuration wherein two assembly openings generally are present. This allows for a further use of an assembly unit. The assembly unit facilitates the procedural installment of heddles with warp threads. The heddles can then be mounted on and dismantled from the slide bars by means of the assembly unit. The assembly and disassembly times can therefore be substantially reduced when, for example, shifting the article to be manufactured.

BRIEF DESCRIPTION OF THE DRAWINGS

The invention will be described in more detail in conjunction with the examples described below. In the drawings.

DESCRIPTION OF THE PREFERRED EMBODIMENTS

Figure 4:
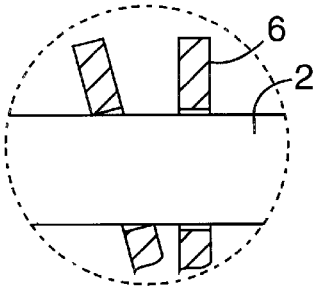
FIG. 4 PRIOR ART
FIG. 4 shows the required play for the inclined angle with respect to the end eyelet of a heddle as arranged at a driving heddle slide bar according to FIG. 3 and as viewed in FIG. 1, partially in section.
Figure 3:
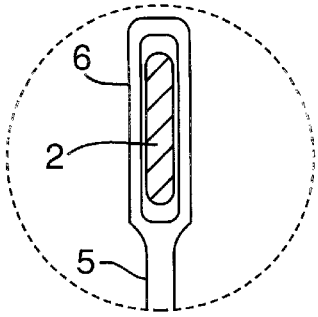
FIG. 3 PRIOR ART
FIG. 3 shows an end eyelet of a heddle as arranged at a driving heddle slide bar in accordance with the view of FIG. 2 but in a larger scale.
Figure 1:
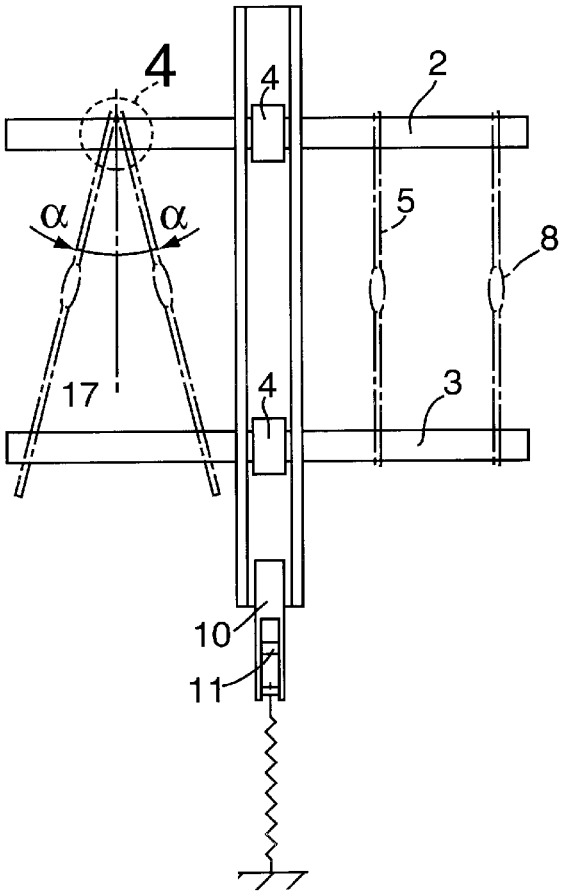
FIG. 1 PRIOR ART
FIG. 1 illustrates a shaft-plane view of a previously known shaft device.
Figure 2:
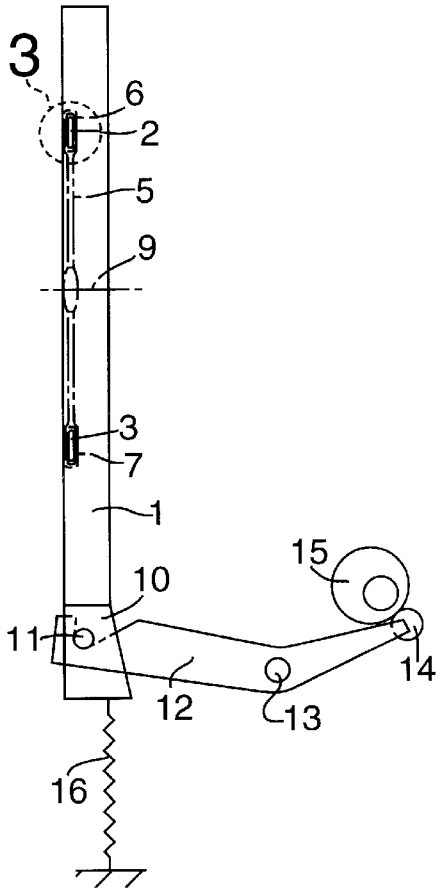
FIG. 2 PRIOR ART
FIG. 2 is a side view of the shaft device in FIG. 1.

FIGS. 1–4 describe a shaft device as the object of, for example, the Swiss document CH-PS 523 987. The shaft device has a vertical profile rod 1, to which an upper driving heddle slide bar 2 and a lower carrier heddle slide bar 3 are each attached by means of clip jaws 4. Heddles 5 are arranged in rows on the driving heddle slide bar 2 and carrier heddle slide bar 3 by means of end eyelets 6, 7. The heddles carry thread eyelets 8, through each one of which a warp thread 9 runs. At the lower end the profile rod 1 comprises an articulation 10 with a bolt 11 which is engaged by a double-armed driving lever 12. The driving lever 12 is mounted in a swingable manner on a shaft 13 and carries a roller 14 on the end opposite to the profile rod. The roller interacts with a driven eccentric 15. A prestressing spring 16 tensions a shaft frame formed by the slide bars 2, 3 in a downward direction and, thus, simultaneously biases roller 14 against the eccentric 15. It can be seen in FIG. 3 the manner in which the end eyelet 6 of the heddle 5 is arranged at the driving heddle slide bar 2 with significant play of for example 0.5–1 mm. This play is necessary to enable the heddle to spread out on both sides of the vertical 17 when, for instance, there is need for thread repair. The separation angle $\alpha$ preferably amounts to 15° relative to the vertical 17.

Figure 6:
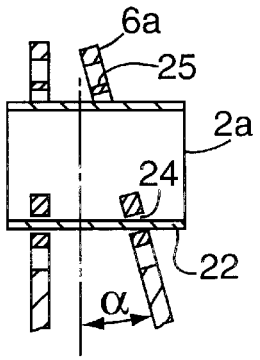
FIG. 6 shows the shaft device according to FIG. 5 in a section taken along line VI—VI.
Figure 5:
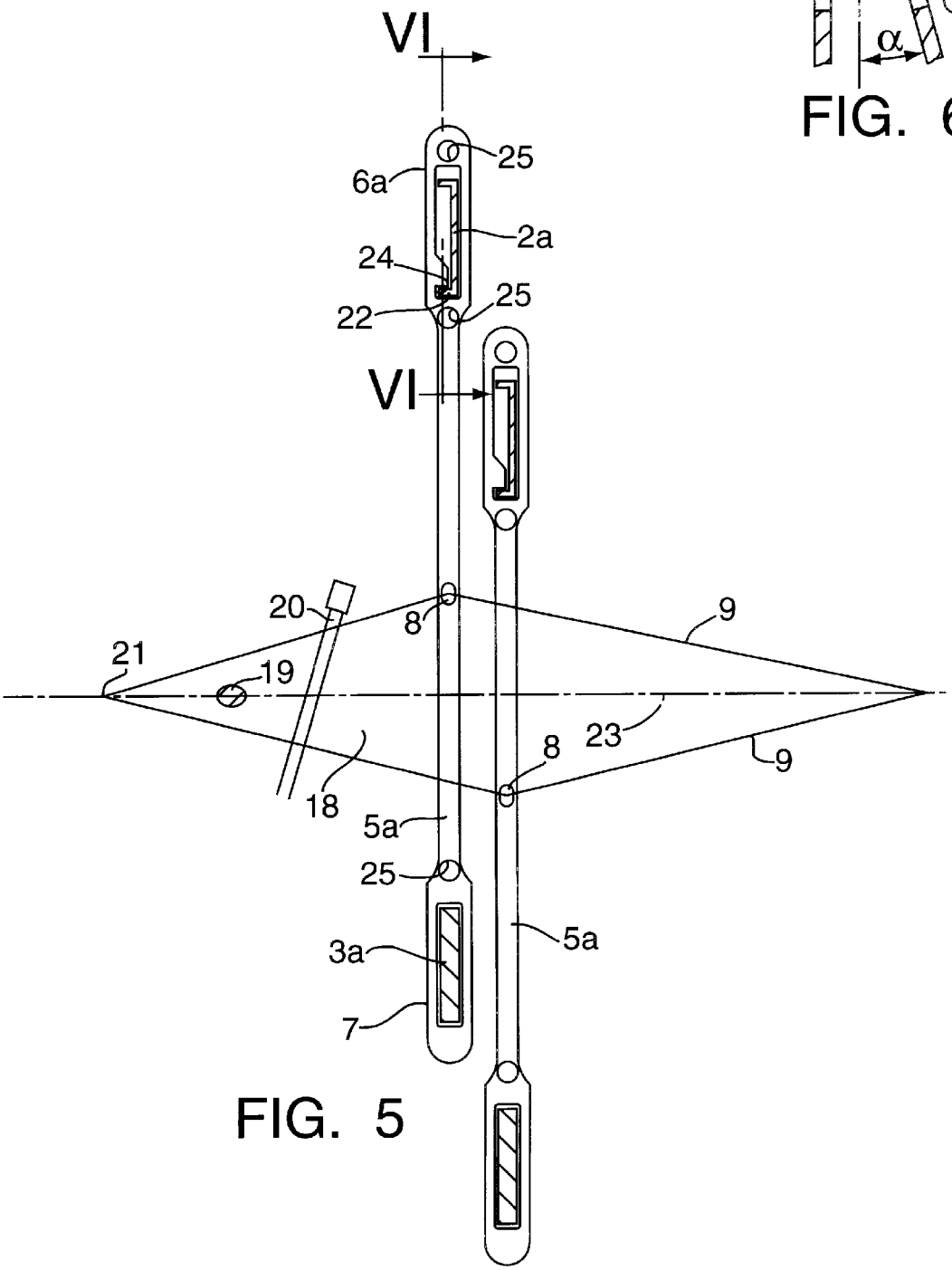
FIG. 5 illustrates the shaft device according to the invention, in a sectional view transverse to the shaft plane.

FIGS. 5 and 6 show a further developed design of the shaft device according to the invention, and for which parts identical to those of the previously known shaft device have the same reference numerals. In FIG. 5 there are shown two heddles 5*a,* to which two shafts have been assigned and which open up warp threads 9 in a warp shed 18. A weft thread 19 can be inserted into the warp shed and is set into agreement with the edge 21 of the goods by means of a weft blade 20. The upper driving heddle slide bar 2*a* has a C-shaped profile. As shown in FIG. 5, at least the end eyelet 6*a* associated with the driving heddle slide bar 2*a* completely surrounds the slide bar 2*a.* The lower leg 22 is parallel to the plane 23 of the warp thread and engages a driving groove 24, which is formed at the inner side of the end eyelet 6*a* of the heddle 5*a.* The leg 22 has a very thin design and a thickness of for example 0.8 mm. The width of the driving groove 24 is correspondingly small and amounts to a maximum of 1.0 mm. The thickness of the leg 22 and the width of the driving groove 24 are adapted to each other in such a way that the play between leg 22 and driving groove 24 of the end eyelet 6*a* amounts to 0.01–0.1 mm, and preferably to 0.05 mm. In spite of this small play it is possible to achieve the spread of heddle 5*a,* the design of which is preferably laminated, by an angle a=15° relative to the vertical as can be seen in FIG. 6. The lower carrier slide bar 3*a* can be designed in the same analogous fashion as the upper driving heddle slide bar 2*a,* allowing for vertical play of 0.5–0.10 mm. The function of carrier slide bar 3*a* is not to drive the heddle 5*a,* but to guide the heddle in the shaft and to carry transverse forces deriving from the moving warp threads. The heddle 5*a* further includes assembly openings 25 to facilitate assembly of heddle 5*a* onto the slide bars 2*a,* 3*a,* which will be described below in more detail in conjunction with FIGS. 9 and 10.

Figure 7:
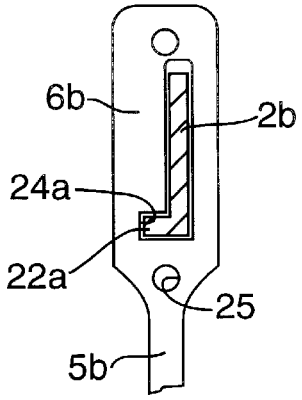
FIG. 7 is a further developed design of the driving heddle slide bar and the corresponding end eyelet of a heddle in a vertical cross-section view.

FIG. 7 illustrates a driving heddle slide bar 2*b* in a cross-sectional L-shaped design. The slide bar interacts with a heddle 5*b* which has a correspondingly shaped end eyelet 6*b.* The leg 22*a* in this instance engages an associated driving groove 24*a* of end eyelet 6*b* which is advanced through the L-shape.

Figure 8:
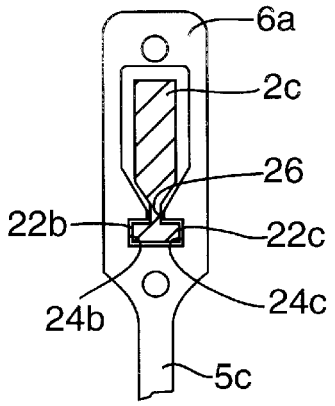
FIG. 8 is a further developed design of the driving heddle slide bar and the end eyelet of a heddle in a vertical cross-section view.

FIG. 8 describes another driving heddle slide bar 2*c,* which has two legs 22*b* and 22*c* pointing in opposite directions and formed into a full profile through slits 26. The opening of the end eyelet 6*c* is made in the same way and also has driving grooves 24*b,* 24*c,* in which the legs 22*b* and 22*c* engage.

Figure 9:
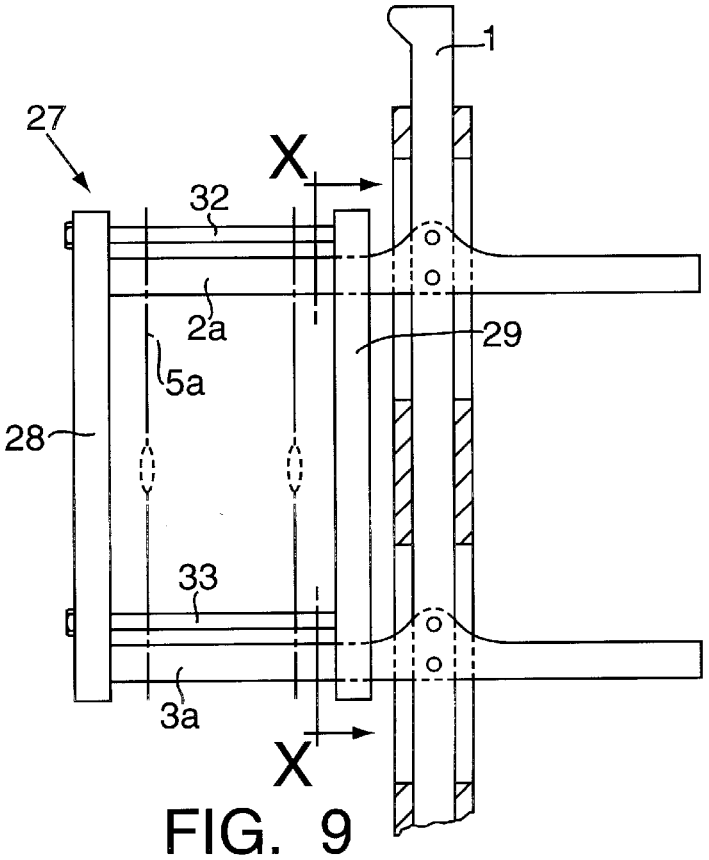
FIG. 9 shows a shaft device with an assembly unit, in a shaft-plane view.
Figure 10:
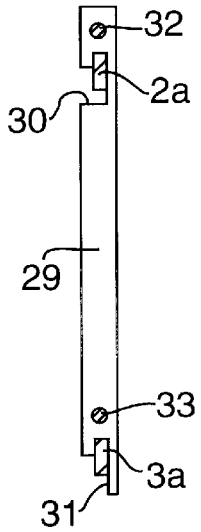
FIG. 10 illustrates the device of FIG. 9 in a section taken along line X—X.

FIGS. 9 and 10 illustrate an assembly unit 27 of the shaft device. It includes at least one end rod 28 or 29, which is advanceable through openings 30, 31 onto the driving heddle slide bar 2*a* and the carrier heddle slide bar 3*a.* The two end rods 28, 29 as illustrated in the present example are interconnected through two assembly rods 32, 33. These assembly rods include screw threads not further detailed herein. The screw threads allow for a removable connection with the end rod 29. The assembly unit 27 serves to receive heddles 5*a* independently of the way the arrangement is at the driving heddle slide bar 2*a* and the carrier heddle bar 3*a.* For the purpose, the end rod 29 is released from the assembly rods 32, 33 so that the heddles 5*a* can be advanced onto the assembly rods 32, 33 by means of the assembly openings 25. It will then be possible, regardless of the arrangement of the slide bars 2*a,* 3*a,* to prepare and equip the heddles with warp threads and, subsequently, after applying the end rod 29 onto the driving heddle slide bar 2*a* and the carrier heddle slide bar 3*a,* mount the heddles. Upon successful assembly, the assembly unit can be removed in that the end rod 29 is released from the assembly rods 32, 33, and the assembly rods 32, 33 are pulled out of the heddles. Because of the openings 30, 32, which are laterally open, the end rod 29 can be removed from the driving heddle slide bar 2*a* and the carrier heddle slide bar 3*a.*

I claim:

1. A shaft device with heddles, each one of which comprising a thread eyelet and end eyelets arranged in rows on heddle slide bars, at least one of the heddle slide bars has a flat profile that serves as a driving heddle slide bar presenting at least one leg projecting transversely to the plane formed by the heddle slide bars and engaging with limited play a driving groove of the corresponding eyelet of the heddle, characterized in that at least the end eyelet associated with the driving heddle slide bar completely surrounds the slide bar, and that the play between the leg of the driving heddle slide bar and the driving groove of the end eyelet amounts to 0.01–0.1 mm.

2. A shaft device according to claim 1, characterized in that at least the driving heddle slide bar has a second leg, which is at the level of and directed in the opposite direction of the first leg, said second leg positioned in the corresponding end eyelet to engage a second driving groove therein.

3. A shaft device according to claims 1, characterized in that the leg is provided on a side of the driving heddle slide bar that faces the thread eyelet.

4. A shaft device according to claim 1, for a weaving a machine handling weft and warp threads characterized in that the leg is aligned parallel to the plane of the warp threads.

5. A shaft device according to claim 1, characterized in that at least the driving heddle slide bar has an L-, C-, or T-shaped cross section.

6. A shaft device according to claim 1, characterized in that the width of the driving groove amounts to 1.0 mm maximally.

7. A shaft device according to claim 1, characterized in that the vertical play between the end eyelet and an idle heddle slide bar amounts to 0.5–10 mm.

8. A shaft device according to claim 1, characterized in that the heddle is laminated.

9. A shaft device according to claim 1, characterized in that the heddle has at least one assembly opening for receiving an assembly unit.

10. A shaft device as claimed in claim 9, characterized in that the heddle slide bars carry the assembly unit, the assembly unit being composed of at least one end rod that is removable through openings located on the heddle slide bars, and attachable by means of at least one assembly rod penetrating the assembly openings of the heddles so as to receive a heddle package.

* * * * *